United States Patent [19]

Brunson

[11] 3,974,483

[45] Aug. 10, 1976

[54] TIME-SHAREABLE AUTOMATIC BOWLING SCORE COMPUTER

[76] Inventor: Raymond D. Brunson, 5404 Brixham Court, Burke, Va. 22015

[22] Filed: Oct. 25, 1974

[21] Appl. No.: 517,864

[52] U.S. Cl. ..... 340/172.5; 340/323 B; 235/92 GA; 273/54 C

[51] Int. Cl.[2] ..... C06F 15/02; C06F 15/44

[58] Field of Search ..... 340/172.5, 323 B; 235/92 GA, 151; 273/54 C

[56] References Cited

UNITED STATES PATENTS

| | | | |
|---|---|---|---|
| 3,093,374 | 6/1963 | Rothberg et al. | 235/151 X |
| 3,295,849 | 1/1967 | Miller et al. | 235/151 X |
| 3,433,479 | 3/1969 | Huck et al. | 273/54 C |
| 3,516,665 | 6/1970 | Danielson | 235/92 GA X |
| 3,665,407 | 5/1972 | Negishi | 340/172.5 |
| 3,718,812 | 2/1973 | Tillman et al. | 235/92 GA X |

*Primary Examiner*—Gareth D. Shaw
*Assistant Examiner*—Melvin B. Chapnick
*Attorney, Agent, or Firm*—Warren H. Kintzinger

[57] ABSTRACT

An automatic scoring system for the game of bowling utilizing 30 scratch memories arranged in 10 successive groups of three, corresponding to the three possible score additions in each of ten successive bowling frames. Input information in the form of successive ball pin scores is sequenced on a common input line to each of the scratch memories. Thirty logic gating circuits, associated with respective individual scratch memories, and operating in time synchronism with the sequenced input information, determine, from the number of ball scores presented and the values of sequential scores, into which one or ones of the scratch memories successive ball scores are entered as a score addition in that place at that time. The system collates consecutive ball scores into the scratch memories such that summation of entries into from one to three of the three scratch memories for a logically determined complete frame represents the score in that frame.

12 Claims, 14 Drawing Figures

Figure 2:
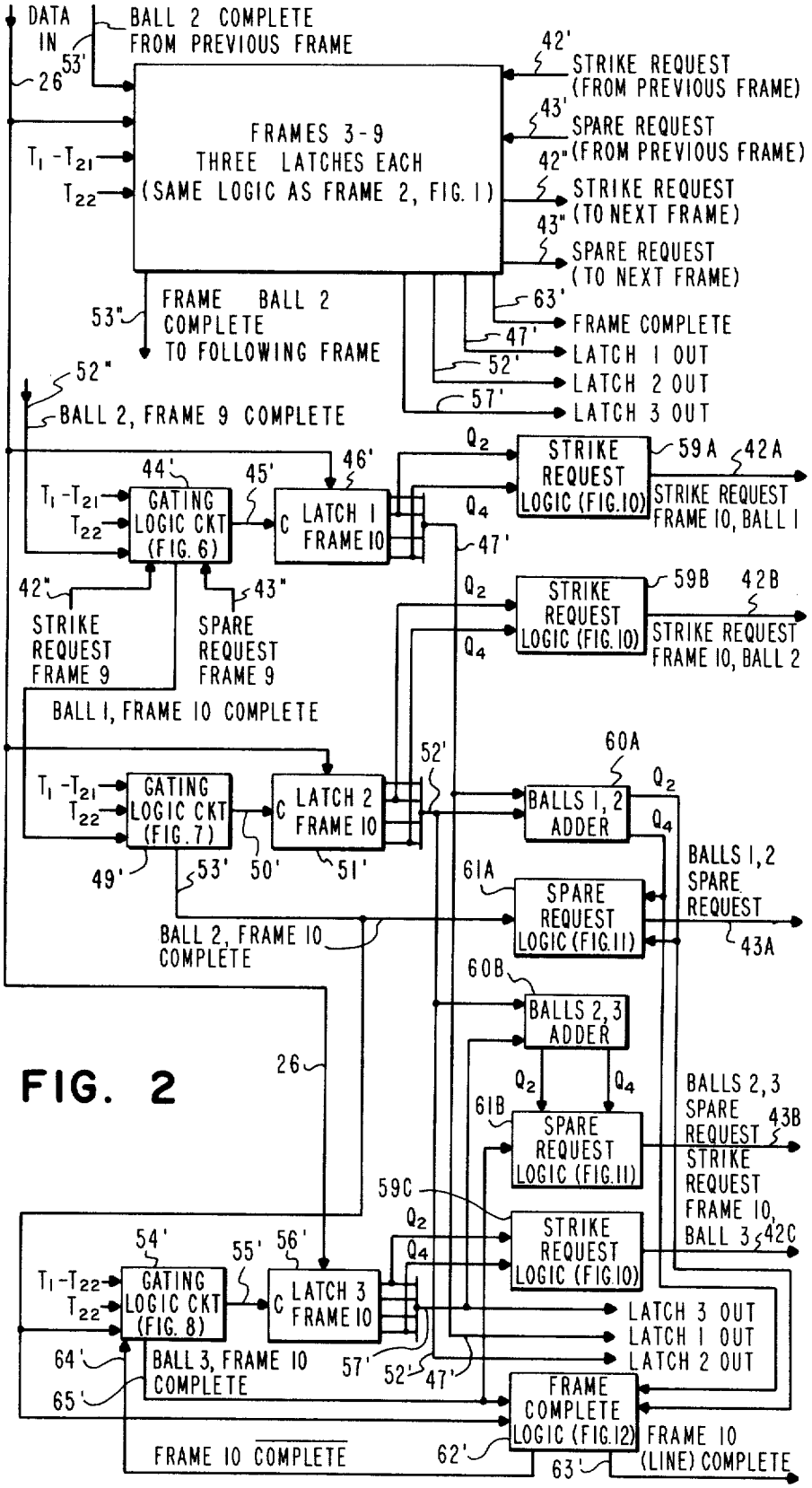

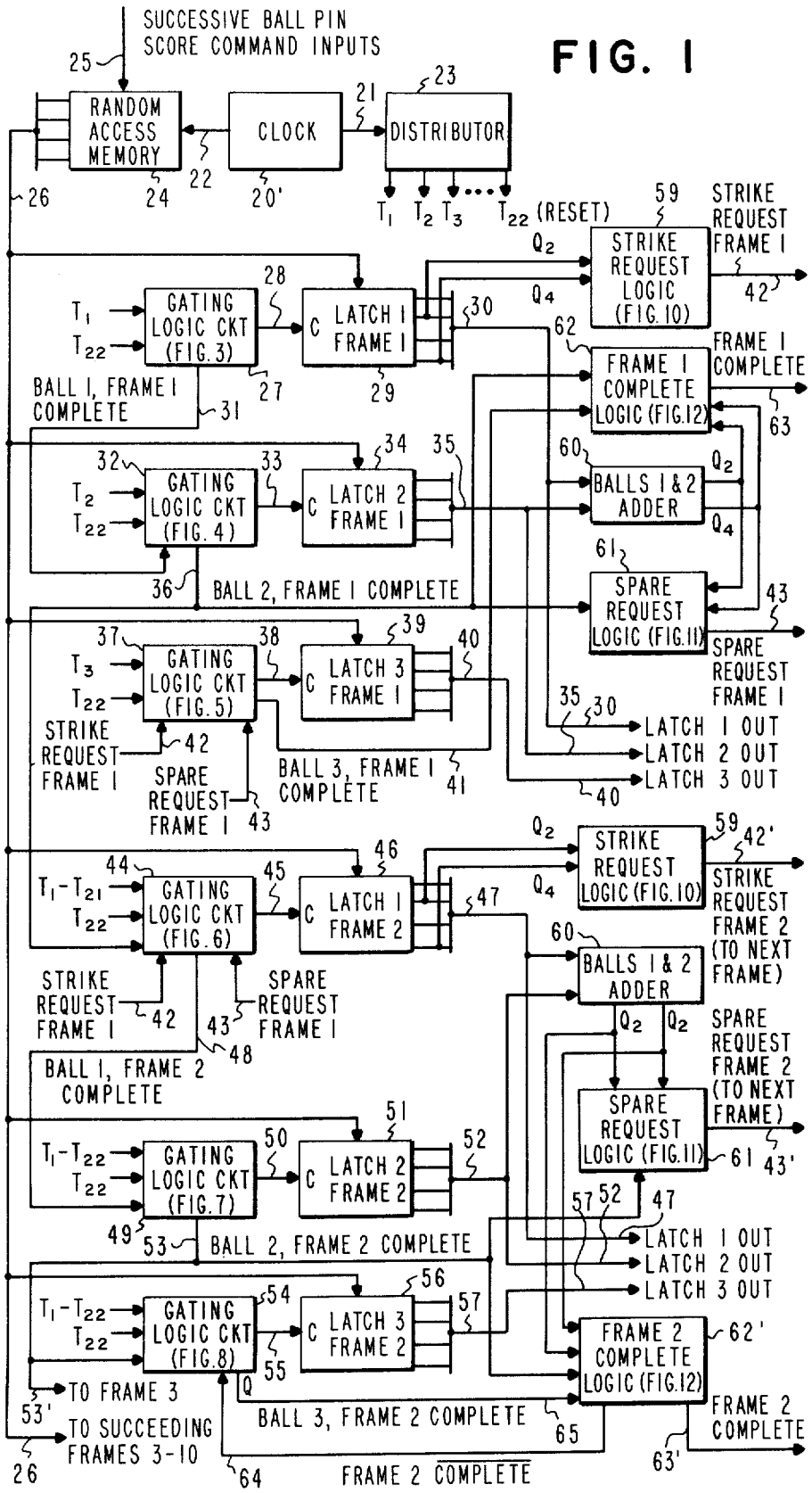
FIG. 1
SUCCESSIVE BALL PIN SCORE COMMAND INPUTS
RANDOM ACCESS MEMORY
CLOCK
DISTRIBUTOR
STRIKE REQUEST LOGIC (FIG. 10)
STRIKE REQUEST FRAME 1
GATING LOGIC CKT (FIG. 3)
LATCH 1 FRAME 1
BALL 1, FRAME 1 COMPLETE
FRAME 1 COMPLETE LOGIC (FIG. 12)
FRAME 1 COMPLETE
GATING LOGIC CKT (FIG. 4)
LATCH 2 FRAME 1
BALLS 1 & 2 ADDER
BALL 2, FRAME 1 COMPLETE
SPARE REQUEST LOGIC (FIG. 11)
SPARE REQUEST FRAME 1
GATING LOGIC CKT (FIG. 5)
LATCH 3 FRAME 1
STRIKE REQUEST FRAME 1
SPARE REQUEST FRAME 1
BALL 3, FRAME 1 COMPLETE
LATCH 1 OUT
LATCH 2 OUT
LATCH 3 OUT
STRIKE REQUEST LOGIC (FIG. 10)
STRIKE REQUEST FRAME 2 (TO NEXT FRAME)
GATING LOGIC CKT (FIG. 6)
LATCH 1 FRAME 2
BALLS 1 & 2 ADDER
SPARE REQUEST FRAME 2 (TO NEXT FRAME)
BALL 1, FRAME 2 COMPLETE
SPARE REQUEST LOGIC (FIG. 11)
GATING LOGIC CKT (FIG. 7)
LATCH 2 FRAME 2
BALL 2, FRAME 2 COMPLETE
GATING LOGIC CKT (FIG. 8)
LATCH 3 FRAME 2
FRAME 2 COMPLETE LOGIC (FIG. 12)
TO FRAME 3
TO SUCCEEDING FRAMES 3-10
BALL 3, FRAME 2 COMPLETE
FRAME 2 COMPLETE
FRAME 2 COMPLETE

TIME-SHAREABLE AUTOMATIC BOWLING SCORE COMPUTER

This invention relates in general to binary number computing devices, and in particular, to an automatic scoring computer for use in the compilation of bowling scores from input information comprising the number of pins knocked down by consecutively rolled balls by any one bowler.

In scoring and compiling performance information in the game of bowling, there is a requirement to produce the following information for each bowler:

1. Total score per frame.
2. Total score per line.
3. Strike request signal per frame.
4. Spare request signal per frame.
5. Frame complete request signal per frame.
6. Line complete request signal per line.

The above information might be obtained from information inputs as to the number of pins knocked down by consecutively rolled balls, by a computing process which follows a program based on manual scoring procedures; that is, conventionally accepting ball score inputs along with inputs concerning strikes and spares rolled. This compilation might be made individually for each bowler by employing highly redundant computing channels, each assigned to a given bowler. This type of compilation would, however, necessitate expensive repetition of computing circuits.

It is, therefore, a principal object of this invention to provide a time-shareable arithmetic unit for compilation of bowling scores, frame-by-frame, from individual ball scores of a plurality of bowlers-each of which may be, at any time, in a different stage of completion of a game line.

Another object is to provide an improved bowling score compiler requiring a minimum of circuit implementations by utilizing time-sharing techniques in the frame-by-frame compilation of bowling scores for a plurality of participants.

A further object is to provide a time-shared arithmetic unit in a bowling score computation system with the arithmetic unit being implemented from plural inclusion of a minimum number of basic logic circuitries by means providing for individual development and storage of each possible scoring addition per frame and summations thereof which provide a running output score, frame by frame.

Features of this invention useful in accomplishing the above objects include, in an automatic scoring system for the game of bowling, a plurality of binary latch storage devices corresponding to the thirty possible scoring additions in any line of bowling. Input information, comprising consecutive ball scores (pins knocked down) for a selected bowler (the number of entries depending on the completion state of that bowler's line) are present in repeated, clocked sequence as a common input to each of the thirty latches. A gating logic circuit for each of the plurality of latches, time synchronized with the scan rate of the inputs to the latches, and including logic determinations of ball complete, strike, and spare situations, determines into which latch or latches, the instantly presented ball score information is entered. The system then repeatedly, for any selected bowler, collates the consecutive ball scores (pins knocked down) into the latches (three latches per frame) such that subsequent summation of the entries in the three latches for a logically determined complete frame represents the score for that frame.

A specific embodiment representing what is presently regarded as the best mode of carrying out the invention is illustrated in the accompanying drawing.

Figure 3:
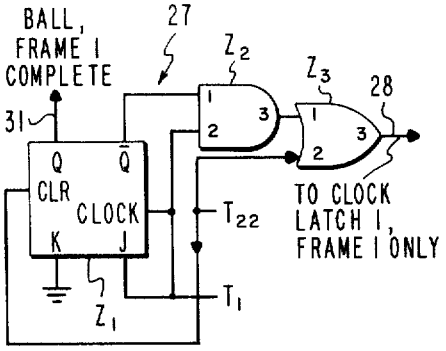
Figure 6:
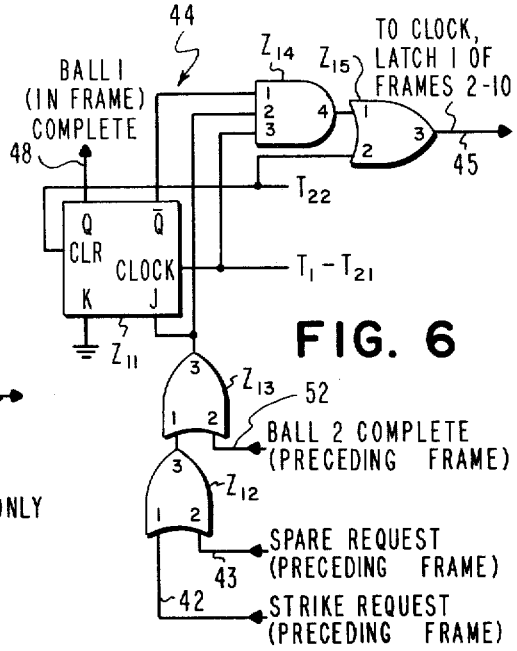
Figure 4:
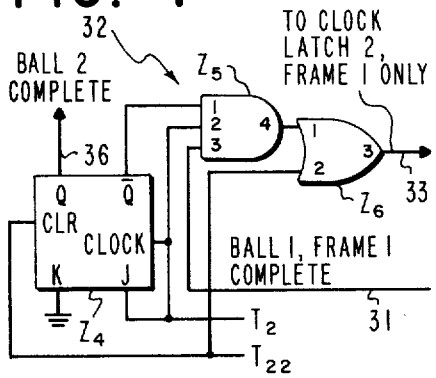
Figure 7:
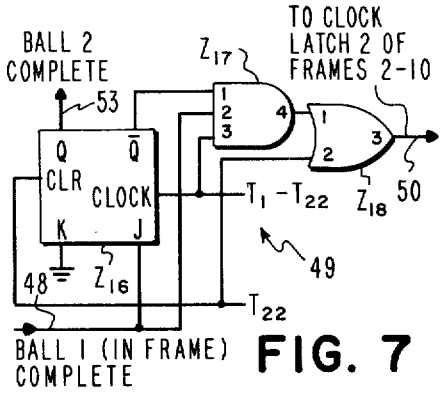
Figure 5:
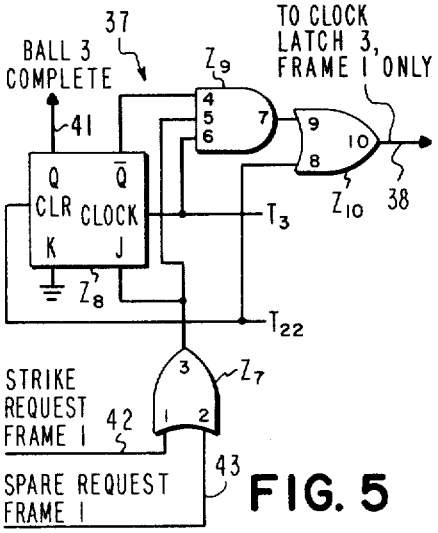
Figure 8:
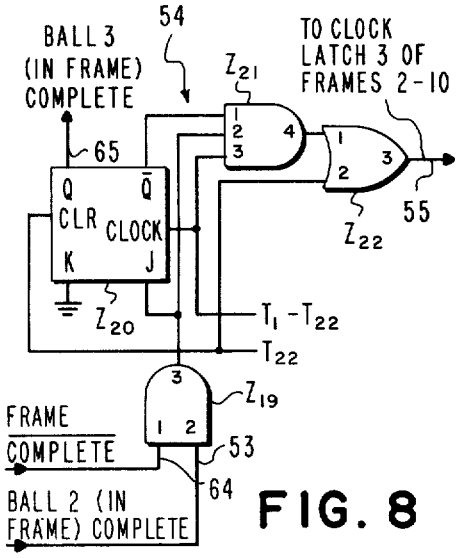
Figure 9:
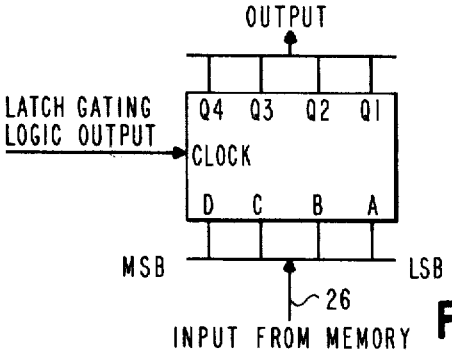
Figure 10:
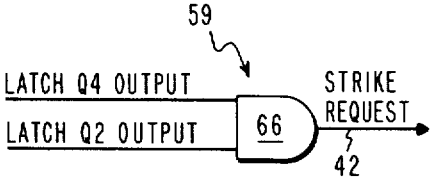
Figure 11:
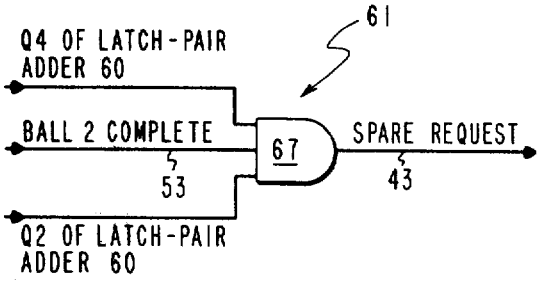
Figure 12:
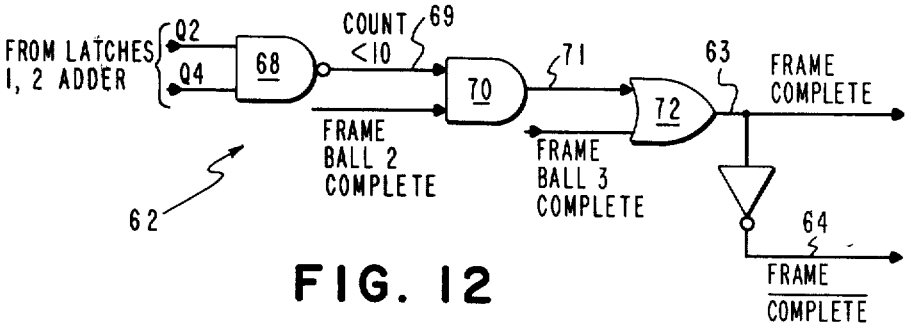
Figure 13:
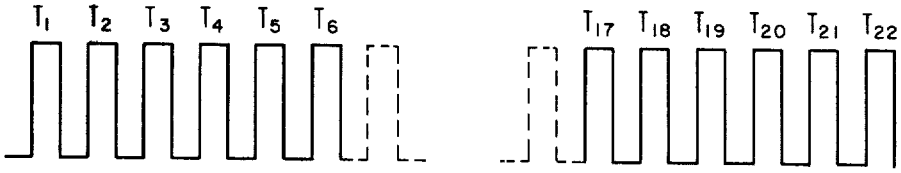
Figure 14:
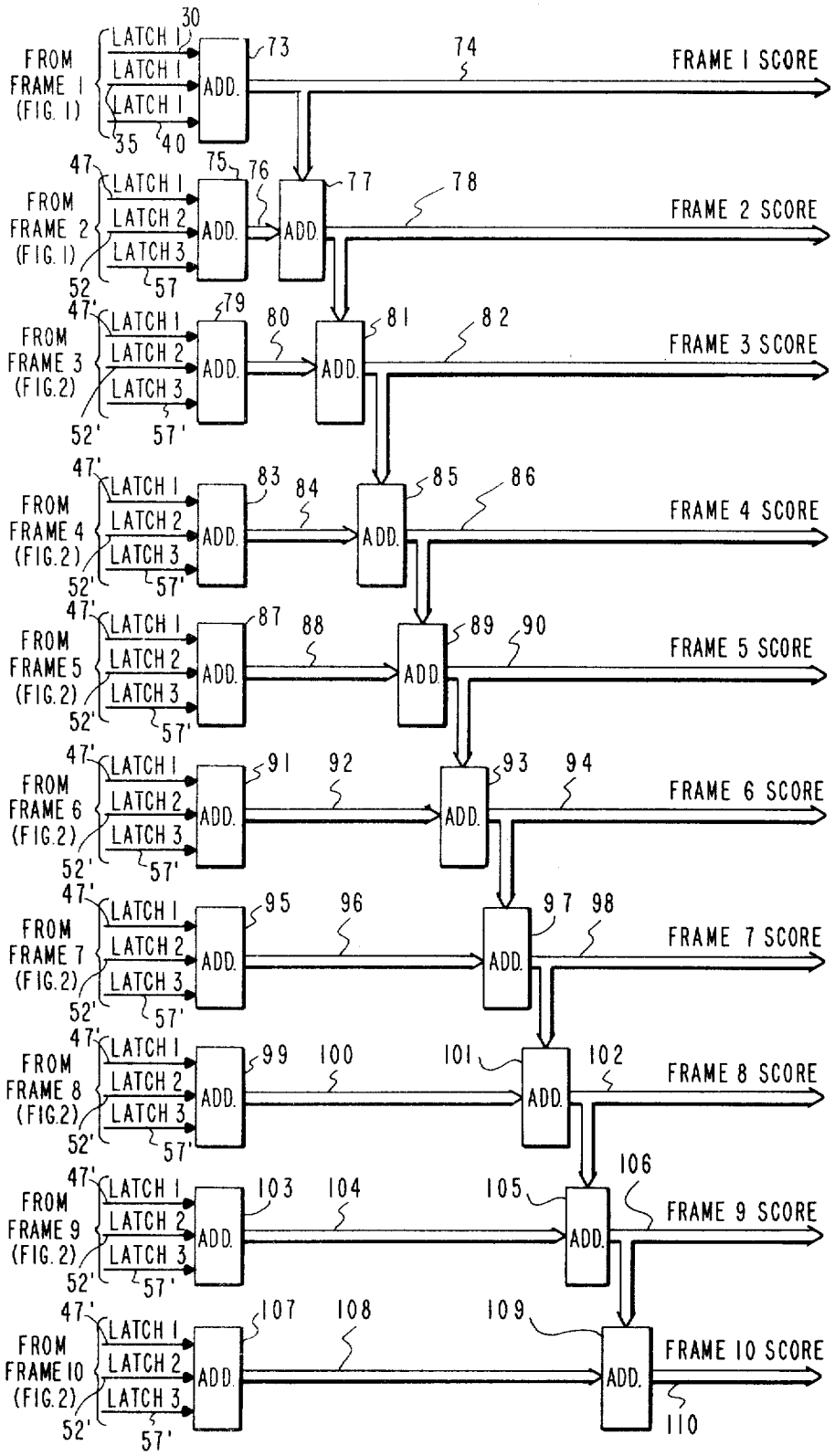

In the drawing:

FIG. 1 represents a functional block diagram of that portion of the arithmetic unit associated with frame 1 and frame 2 scoring;

FIG. 2, a continuation of the functional block diagram, depicting that portion of the arithmetic unit associated with frames 3 through 10;

FIG. 3, gating logic circuitry used to clock latch 1 of frame 1;

FIG. 4, gating logic circuitry used to clock latch 2 of frame 1;

FIG. 5, gating logic circuitry used to clock latch 3 of frame 1;

FIG. 6, gating logic circuitry used to clock latches 1 of frames 2 through 10;

FIG. 7, gating logic circuitry used to clock latches 2 of frames 2 through 10;

FIG. 8, gating logic circuitry used to clock latches 3 of frames 2 through 10;

FIG. 9, a functional diagram of the latches employed;

FIG. 10, logic circuitry for strike request signal generation as used repeatedly in FIGS. 1 and 2;

FIG. 11, logic circuitry for spare request signal generation as used repeatedly in FIGS. 1 and 2;

FIG. 12, logic circuiry for frame completion signal generation as used repeatedly in FIGS. 1 and 2;

FIG. 13, a representative timing waveform as applied to synchronize the gating logic circuits of the unit with the data input thereto; and, FIG. 14, a functional block diagram of output score tabulating means useful with the system of FIGS. 1 and 2.

Referring to the drawing:

FIGS. 1 and 2, collectively, represent a block diagram of the arithmetic unit. The unit is seen to be comprised of 30 latches, with three latches being utilized for each of 10 frames. As concerns bowling scoring, one latch is provided for each of the three possible scoring additions for each of ten frames.

Input information, comprised of repeatedly scanned consecutive ball scores for a selected bowler, is applied in common to each of the 30 latches, and logically defined clock inputs to each of the 30 latches determine into which latch, or latches, successive balls scores are entered for scoring purposes.

Since the ball score input information comprises knocked-down pins per ball rolled, with magnitudes of anywhere from zero to 10, this information may be stored in four-bit binary format in a random access memory in response to a manual scorekeeper entry representing the number of pins knocked down by the bowler on each consecutively rolled ball. This stored information may be scanned continuously, starting at one (or first entry) and continuing to 21 (the last possible entry), and then repeated (starting at one) after a particular bowler has been selected.

The scanning of the random access memory, or memories, may then be synchronized with the scanning of the arithmetic unit, and it is to be realized that the scanning may involve time-sharing of the arithmetic unit with plural player scores, and with scores from two lanes. For purpose of the present invention, the input information is a repeated readout of a selected bowler's consecutive ball scores on a selected lane. As will be evident from further discussion, the arithmetic unit continuously collates ball score entries in repeated fashion, with intervening zero reset, permitting a wide latitude in desired time sharing as to individually selected bowlers and lanes, and with no restriction upon the degree of completion of any one bowler's line on either of two lanes.

Synchronization of the arithmetic unit operations with the input ball score information sequence is accomplished by a repeated clocking waveform of 21 pulses followed by a 22 (reset) pulse. The 21 pulses represent the maximum number of balls that can be rolled in any one line of bowling. No matter what score any bowler may get, he can roll no fewer than 12 balls, nor any more than 21 in any one line. Therefore, the arithmetic unit is presented with between 12 and 21 binary coded decimal numbers in repeatedly scanned time sequence. These numbers correspond to the consecutive ball scores of a selected player, and it is the function of the arithmetic unit to collate these numbers so that they appear in the proper frames for scoring purposes. The organization of the information takes place in devices termed, "four-bit latches," and each of the latches comprises a scratch memory, because information is arranged and remembered from $T_1$ through $T_{21}$ of the timing waveform (FIG. 13), and then cleared or erased on $T_{22}$.

Referring now to the arithmetic unit depicted functionally in FIGS. 1 and 2, 30 latches (scratch memories) are arranged in groups of three for each of 10 frames to correspond to the three possible score additions each frame and maximum of 30 score additions per line.

Each of the latches, as depicted in FIG. 9, comprises a four-bit scratch memory. Binary input data is presented at the input of the latch with A being the least significant bit and D being the most significant bit. When the clock input to the latch is high, the input data is transferred to the output. However, when the clock input goes low, the output $Q_1 - Q_4$ will retain what the input was just previously to the clock going low and the input may then change in any manner without changing the output. The output of the latch can be changed only when the clock input to the latch goes high again. As will be described, the clock inputs to the latches are time synchronous with particular ones of the timing waveform pulses $T_1 - T_{22}$ as determined by a logic gating circuitry associated with each of the latches by means of which the clock input for that latch is generated. Now, if the clock inputs of the 30 latches depicted in the block diagram of FIGS. 1 and 2 can be made to go high and low at the proper time, the 12 to 21 binary coded decimal scores repeatedly sequenced on the input data line as a common input to all 30 latches, can be collated for each latch, each frame, and each line.

FIG. 1 thus depicts a clock source 20 functionally connected by lines 21 and 22 to a pulse distributor 23 and random access memory 24. Random access memory 24, having stored therein consecutive ball score entries in four-bit BCD format from manual inputs 25, is continually scanned through consecutive addresses, one through 21, to read out ball score entries for a selected bowler, on data line 26. The distributor 23 may develop line distributed output pulses corresponding to consecutive times $T_1$ through $T_{21}$ at which the memory 24 is caused to read out score entries on consecutive balls rolled by that player. A 22 pulse (reset) is generated after each pulse $T_{21}$. Thus during time $T_1$, the data input 26 corresponds to the first ball score of a selected bowler; during time $T_2$, the data input 26 corresponds to the second ball score of that player, etc.

As above-mentioned, this input data is applied in common as input to each of the thirty latches of FIGS. 1 and 2, and whether or not the data score is entered into the output of any particular latch depends on the level of the clock input to that latch at that time.

The clock input to each latch comprises the output of an individually associated logic gating circuitry which is responsive to the timing pulses $T_1 - T_{22}$, and to certain logic inputs definitive of frame related ball completions, strike requests, spare requests, and frame completion determinations to generate a high level clock input to its associated latch (and thus enter the ball score data present on the common input data line). The circuitry to be described generates clock pulses for a particular one (or ones) of the 30 latches to properly collate the consecutive ball score inputs into the latches, such that the sum of the entries into the three latches associated with each frame is the score for that frame.

The circuitry may best be described by considering the three latches and associated gating logic circuitry on a frame-by-frame basis. Strike request, spare request, and frame completion logic inputs for the gating logic circuits will be first considered on the basis of whether or not this information is present. The logic means by which these informational inputs to the gating logic circuits are generated will then be considered.

FRAME 1 COLLATING GATING LOGIC:

Considering first the logic to clock the latch 29 associated with timing pulse $T_1$ (latch 1, frame 1), FIG. 1 depicts the input data line 26 applied to the input of latch 29. The clock input 28 to latch 29 is generated by an associated gating logic circuit 27, the logic implementation of which is shown in FIG. 3.

With reference to FIG. 3, gating logic circuitry 27 for latch 29 (latch 1, frame 1) is comprised of a J–K flip-flop $Z_1$, AND gate $Z_2$, and OR gate $Z_3$. Timing pulse $T_1$ is applied to the J input of flip-flop $Z_1$, to the clock input of $Z_1$; and as a first input to AND gate $Z_2$. Timing pulse $T_{22}$ (the reset pulse) is applied as a first input to OR gate $Z_3$ and to the CLEAR input of flip-flop $Z_1$. The Q output of flip-flop $Z_1$ is applied as a second input to AND gate $Z_2$, and the output of AND gate $Z_2$ comprises the second input to OR gate $Z_3$. The output ($Z_3$-3) of OR gate $Z_3$ comprises the clock signal 28 applied to latch 29 of FIG. 1.

Under initial conditions, $\overline{Q}$ of FIG. 3 is high and Q is low. When the clock input to $Z_1$ goes high and the J input goes high simultaneously, the output of $Z_1$ becomes $\overline{Q}$ low and Q high. When the CLEAR input to $Z_1$ goes high, it will reset to $Z_1$ to where $\overline{Q}$ is high and Q is low.

Operation of the logic gating circuit of FIG. 3 may be summarized as follows:

Initial Conditions:

$T_1$=0
$Z_1$ (J and clock) and $Z_2$-2=0
$Z_1$-$\overline{Q}$, $Z_2$-1=H, $Z_2$-3=0, $Z_3$-1=0
$Z_3$2=0
$Z_3$-3=0

Condition:

$T_1$=High
$Z_1$ (J and clock) and $Z_2$-2=H

-continued $Z_1$-$\overline{Q}$. $Z_2$-1=H
$Z_2$-3=H
$Z_3$-1=H
$Z_3$-2=0
$Z_3$H

Condition after $T_1$ goes back to 0:

$T_1$=0
$Z_1$Q and $Z_2$-1=0
$Z_1$-(J and clock)=0
$Z_2$-3=0
$Z_3$-1=0
$Z_3$-3=0

Condition at $T_{22}$=H:

$T_1$=0
$Z_1$-(J and clock)=0
$Z_1$ $\overline{Q}$ and $Z_2$1=H
$Z_1$clear=H
$Z_2$-3=0
$Z_3$-2=H
$Z_3$-3=H Considering now the logic to clock the latch 34 associated with timing pulse $T_2$ (latch 2, frame 1), FIG. 1 depicts the input data line 26 applied to the input of latch 34. The clock input 33 to latch 34 is generated by associated gating logic circuitry 32, the logic implementation of which is shown in FIG. 4.

With reference to FIG. 4, gating logic circuitry 32 for latch 34 (latch 2, frame 1) is similar to that of the above described gating logic circuit 27 and is comprised of a J–K flip-flop $Z_4$, an AND gate $Z_5$, and an OR gate $Z_6$. The timing pulse input now becomes $T_2$. Reset pulse $T_{22}$ is similarly applied. AND gate $Z_5$, however, receives a third input 31, corresponding to a high input (from $Z_1$Q of the latch 1 logic, FIG. 3) indicative of ball 1 of frame 1 being completed. The output ($Z_6$-3) of OR gate $Z_6$ comprises the clock signal 33 applied to latch 34 of FIG. 1.

Operation of the logic gating circuit 32 of FIG. 34 may be summarized as follows:

Initial Conditions:

$T_2$=0
$Z_4$-Q=H
$Z_5$-4=0
$Z_6$-3=0

Operating Conditions:

$T_2$=H
$Z_5$-3=H
$Z_5$-2=H
$Z_5$-1=H
$Z_5$-4=H
$Z_6$-3=H

After Operating Conditions:

$T_2$=0
$Z_5$-3=H
$Z_5$-2=0
$Z_5$-1=0
$Z_5$-4=0
$Z_6$-3=0

Reset:

$T_{22}$=H
$Z_5$-3=0
$Z_5$-2=0
$Z_5$-1=H
$Z_5$-4=0
$Z_6$-2=H
$Z_6$-3=H

The logic to clock the latch 39 associated with timing pulse $T_3$ (latch 3, frame 1) is provided by the logic gating circuit 37, which may be implemented shown in FIG. 5.

With reference to FIG. 5, gating logic circuit 37 for latch 39 (latch 3, frame 1) is again similar to those described for the latches 29 and 34. The circuit comprises a J–K flip-flop $Z_8$ to which timing pulse $T_3$ is applied as a clock input. The J input of flip-flop $Z_8$ now comprises the output of an OR gate $Z_7$ to which strike request Frame 1 logic 42 and Spare request Frame 1 logic 43 are applied as respective inputs. (The generation of the strike and spare request logic inputs 42 and 43 will be further discussed. For now, let it be assumed that a first ball score in frame 1 of 10 generates a high strike request frame 1 logic level 42, and that ball scores on first and second balls in frame 1 which total ten will generate a high spare request frame 1 logic level 43). The output ($Z_{10}$10) of OR gate $Z_{10}$ comprises the clock signal 38 applied to latch 39 of FIG. 1.

Operation of the logic gating circuit 37 of FIG. 5 may then be summarized as follows:

Initial Conditions: $T_3$=0, $T_{22}$=0
When a strike request or spare request is present in frame 1: $Z_8$–J=H, $Z_9$–5=H
Then, when $T_3$=H: $Z_9$–4=H, $Z_9$–5=H, $Z_9$–6=H
Therefore: $Z_9$–7=H and $Z_{10}$–10=H
When $T_3$ goes back low: $Z_8$–Q=0 and $Z_{10}$–10=0, when $T_{22}$=H,$Z_8$–Q=H, $Z_{10}$–10=H

FRAME 2 COLLATING GATING LOGIC

As depicted in FIG. 1, the logic to clock the latch 46 (latch 1, frame 2) is provided by logic gating circuit 44, which may be implemented as shown in FIG. 6.

With reference to FIG. 6, gating logic circuit 44 for latch 46 (latch 1, frame 2) is comprised of a J–K flip-flop $Z_{11}$, AND gate $Z_{14}$, and OR gates $Z_{12}$, $Z_{13}$, and $Z_{15}$. Timing pulses $T_1$ through $T_{21}$ (the entire sequence) are applied to the clock input of the flip-flop $Z_{11}$ and to AND gate $Z_{14}$. Reset pulse $T_{22}$ is applied to the CLEAR input of the flip-flop $Z_{11}$ as well as to OR gate $Z_{15}$. The J input of flip-flop $Z_{11}$ comprises the output of OR gate $Z_{13}$. $Z_{13}$ receives a first input comprised of the Q output of the J–K flip-flop associated with logic gating circuitry for latch 2 of the preceding frame. (As concerns latch 1 of frame 2, this input comprises the Q output 36 of the flip-flop $Z_4$ in FIG. 4). Spare request input 42 from preceding frame 1 and strike request input 43 from preceding frame 1 are applied to OR gate $Z_{12}$, the output of which is applied as a second input to OR gate $Z_{13}$. The output $Z_{15}$–3 of OR gate $Z_{15}$ comprises the clock signal 45 applied to latch 46 of FIG. 1.

In operation, $Z_{11}$ –J goes high when $Z_4$ Q is high (ball 2, frame 1 complete) or when there is a spare request or a strike request from frame 1. The output of $Z_{11}$ will change when $Z_{11}$–J is high and $Z_{11}$ clock goes from high to low. The output $Z_{15}$–3 of OR gate $Z_{15}$ comprises the clock signal 45 applied to latch 46 of FIG. 1.

Operation of the logic circuitry 44 of FIG. 6 may then be summarized as follows:

Initial Conditions:

$Z_{11}\overline{Q}$=H
$Z_{14}$-4=0
$Z_{15}$-3=0

Conditions after $Z_{11}$-J=H and $Z_{11}$ clock goes high:

$Z_{11}\overline{Q}$=H
$Z_{14}$-4=H
$Z_{15}$-3=H

Conditions after $Z_{11}$-J=H and $Z_{11}$ clock goes from high to low:

$Z_{11}\overline{Q}$=0
$Z_{14}$-4=0
$Z_{15}$-3=0

The logic to clock the latch 51 (latch 2, frame 2) is provided by logic gating circuit 49, which may be implemented as shown in FIG. 7.

With reference to FIG. 7, logic gating circuit 49 is comprised of a J–K flip-flop $Z_{16}$, AND gate $Z_{17}$, and OR gate $Z_{18}$. Inputs comprise ball 1, frame 2 completed logic 48 (from $Z_{11}$—Q of FIG. 6) along with timing pulses $T_1$–$T_{22}$. The output ($Z_{18}$—3) of OR gate $Z_{18}$ comprises the clock signal 50 applied to latch 51 of FIG. 1.

Operation of the logic circuit 49 of FIG. 7 may be defined as follows:

Initial Conditions:

$Z_{16}$-$\bar{Q}$=H
$Z_{17}$-4=0
$Z_{18}$-3=0

$Z_{16}$-J goes high when $Z_{11}$-Q (ball No. 1, frame No. 2 complete) goes high.

Conditions when $Z_{16}$-J=H and $Z_{16\ clock}$=u:

$Z_{16}$-$\bar{Q}$=H
$Z_{17}$-4=H
$Z_{18}$-3=H

Conditions after $Z_{16}$ - clock goes from H to 0:

$Z_{16}$-$\bar{Q}$=0
$Z_{17}$-4=0
$Z_{18}$-3=0

Reset to initial conditions occurs when $T_{22}$ goes high.

The logic to clock the latch 56 (latch 3, frame 2) is provided by logic gating circuitry 54, which may be implemented as shown in FIG. 8.

With reference to FIG. 8, logic gating circuit 54 is comprised of J–K flip-flop $Z_{20}$ AND gates $Z_{19}$ and $Z_{21}$, and OR gate $Z_{22}$. Inputs comprise ball 2, frame 2 complete logic 53 (from $Z_{16}$—Q of FIG. 7), a frame completed logic input 64 (details of which will be further discussed), along with timing pulses T, through $T_{21}$ and $T_{22}$ (reset). The output ($Z_{22}$—3) from OR gate $Z_{22}$ comprises the clock signal 55 applied to latch 56 of FIG. 1.

Operation of the logic circuit 54 of FIG. 8 may be defined in the following manner:

Initial Conditions:

$Z_{20}$—$\bar{Q}$=H $Z_{21}$—4=0

$Z_{22}$—3=0

$Z_{20}$—J goes high when:

$Z_{19}$—1=H $Z_{19}$—2=H $Z_{19}$—1 and $Z_{19}$—2 go high when a signal is present showing frame 2 is not complete and there is a signal present which says ball 2 of frame 2 is complete. When this occurs, conditions are:

$Z_{19}$—1H $Z_{19}$—2=H $Z_{19}$—3=H

When the above condition occurs and the clock of $Z_{20}$ is high, conditions are:

$Z_{19}$—3=H $Z_{20}$—$\bar{Q}$=H $Z_{21}$—4=H $Z_{22}$—3=H

Then when the clock of $Z_{20}$ goes from high to low:

$Z_{20}$—$\bar{Q}$=0

$Z_{21}$—4=0

$Z_{22}$—3=0

Initial conditions return when reset pulse $T_{22}$ occurs.

FRAMES 3–10 COLLATING GATING LOGIC

The gating logic circuits 44,49, and 54 described above for frame 2 are repeated for frames three through 10. As depicted in FIG. 2, the logic gating for frames 3 through 9 is functionally depicted as each being the same as that for frame 2, FIG. 1. The three latches for each of these frames receive input data line 26 in common. The gating logic circuits receive timing pulses $T_1$–$T_{21}$ on a first input line and reset timing pulse $T_{22}$ on a further input line.

The first latch (latch 1) for each of frames 3 through 9 receives a ball two complete logic input 53' from latch 2 of the previous frame. FIG. 2 depicts the logic for each of frames 3–9 as receiving a strike request 42' from the previous frame, a spare request 43' from the previous frame, and providing an in-frame strike request 42'' and in-frame spare request 43'' to the next frame. Each frame logic also is depicted as providing a ball two complete logic output 53'' to the next frame and a frame complete logic output 63'.

Although the three gating logic circuits for frame 10 are the same as those for frames 2 through 9, FIG. 2 repeats the functional block showing of logic circuits and associated latches for frame 10 for purposes of further discussion relating to spare and strike request logic means peculiar only to frame 10.

SUMMARY OF GATING LOGIC FUNCTIONS

The above discussion has considered the logic circuits which develop appropriate clock outputs for each of the thirty scratch memories for the purpose of collating successive ball scores therein. As previously discussed, the successive ball scores are presented as binary coded decimal inputs during the time occurrence of timing pulses T, through $T_{21}$. Timing pulses $T_1$ through $T_{21}$ are, in turn, utilized to address a random access memory into which the ball scores for each player have been stored. The gating logic circuits then determine into which latch, or latches, the successive ball scores presented on data line 26 are entered. Entry into a latch is conditioned upon a clock input being generated for that latch at the time that a data word is present on line 26. Thus the output signal of each of the logic gating circuits of FIGS. 3–8 comprises a clock input for an associated latch.

FIG. 9 functionally depicts the latches as comprising four bits. Binary inputs are applied on inputs A, B, C and D, with A being the least significant bit and D, the most significant bit. Outputs are at $Q_1$ through $Q_4$, with $Q_1$ being the least significant bit and $Q_4$, the most significant bit. When the clock of the latch (the output of the associated gating logic circuit) is high, the input information A–D is transferred to the output $Q_1$–$Q_4$. When the clock of the latch goes from high to low, the output retains the information of what was present on the input just previous to the clock going low.

As above described, there is one latch for each ball in each frame. Therefore there are three latches per frame for a total of 30 latches per line. The latches, each functioning as a four-bit scratch memory, collectively organize the numerical data stored in the random access memory into bowling score per ball, per frame. For example, the first number is presented by the random access memory at time $T_1$ on data line 26 and the circuitry described above collates it to the latch of the first ball in the first frame. This latch (latch 29, FIG. 1) stores that score. When the next number is presented at time $T_2$ on data line 26, it is stored in the correct place as determined by the above described logic gating circuits. It will be noted that a single number from the random access memory may be stored in more than one latch, in fact, one output number of the random access memory may be stored in anywhere from one to three latches, depending on the gating logic conditions previously described.

From these stored scores in the latches, many quantities of the score may be measured. Of interest for score measuring purposes, as well as for development of logic inputs necessary to complete the gating logic functions, are strike request, spare request, frame complete request, total score per frame, total score per line, and line complete request. These determinations may be made from a continuous logical "look" at the numbers stored in the 30 latches.

STRIKE REQUEST SIGNAL

The definition of a strike is ten pins knocked down on one ball. This may occur on the first ball of each frame, and on the second and third balls as well, in the tenth frame. Therefore a logic "look" at the scores in the latches corresponding to these balls may be made, and if a score of 10 is recorded there, a strike has occurred in that particular frame and place. The logic circuit is simple and shown in FIG. 10 to be comprised of a signal AND gate. The binary equivalent for the decimal number 10 is 1010, with 1 beng the most significant bit. Therefore the strike request logic circuit 59 may comprise an AND gate 66 to which the $Q_4$ and $Q_2$ outputs of a latch are applied as respective inputs. The output 42 of the AND gate 66 will go high only when 10 (equilavent to a strike) is stored in the latch. Referring to FIGS. 1 and 2, latch 1 of each frame 1 through 10 is depicted as having its respective $Q_2$ and $Q_4$ output bits connected to a strike request logic block 59. In addition, with reference to FIG. 2, the second and third latches 51' and 56' of frame 10 also have their respective $Q_2$ and $Q_4$ output bits connected to strike request logic circuits **59*b* and 59*c***.

SPARE REQUEST SIGNAL

The spare occurs when 10 pins are knocked down on two balls. This may occur in any of the frames 1 through 9 and may occur on balls one and two or balls two and three of frame 10. Therefore if the scores in the latches for these ball-pairs are added together, and, if that sum is 10, and, if there have been two balls rolled, then a spare has occurred. The spare request logic may then comprise an AND gate as shown in FIG. 11, operating in conjunction with an adder circuit as depicted in FIGS. 1 and 2. The spare request logic block 61 depicted in FIG. 11 comprises an AND gate 67 with three inputs. A first input comprises a ball two complete logic input (i.e., output 36 from gating logic circuit 32 for frame 1). The second and third inputs to AND gate 67 comprise the respective $Q_2$ and $Q_4$ bit outputs of an adder which sums the score of the two balls under consideration (first and second balls of all frames and, in addition, the second and third balls of frame 10).

With reference to FIG. 1, an adder 60 receives the four-bit outputs 30 and 35 of latches 29 and 34 (balls one and two) and the $Q_2$ and $Q_4$ bits outputs of the adder output are applied to spare request logic block 61. Similarly, for frame 2 (and subsequent frames 3–10), an adder 60 sums the outputs 47 and 52 from latches 46 and 51 (balls one and two) and the $Q_2$ and $Q_4$ bit outputs of adder 60 are applied to a spare request logic block 61. In addition, for frame 10 (FIG. 2), a further adder **60*b* sums the outputs 52' and 57' from latches 51' and 56' (balls two and three) and the $Q_2$ and $Q_4$ bit outputs of adder 60*b* are applied to a further spare request logic block 61*b***.

For all frames, the spare request logic blocks receive a third input comprising an in-frame ball completion signal (the second ball of the ball-pair under consideration) from the associated gating logic circuit.

FRAME COMPLETE SIGNAL

A frame is complete when two balls have been rolled and total pins knocked down is less than 10, or, when three balls have been rolled. Therefore logic may be set up, as depicted in FIG. 12 to look at the output of adders for ball one and ball two and to look at whether balls two and three have been rolled. The first condition is that of two balls rolled and score total less than ten. FIG. 12 depicts the frame complete logic circuit 62 as comprising a NAND gate 68 receiving the $Q_2$ and $Q_4$ bit outputs from an adder which sums the output of the first and second latches in each of frames 2 through 10. The output 69 of NAND gate 68 is high for $Q_2$ and $Q_4$ bits of binary representations of decimal numbers zero through nine, and is low for the $Q_2$ and $Q_4$ bits of the binary representation of decimal number 10. Therefore, if the sum of ball one and ball two scores is less than 10, the output 69 of NAND gate 68 is high. When this high output is ANDed with a high signal representing ball two completion in the frame (AND gate 70), the output 71 of AND gate 70 is passed through OR gate 72 as a high output 63, signifying frame completion. Also, a ball three completed logic input (from the gating logic circuit which clocks latch three in the frame) passes through OR gate 72 as a high output 63, signifying frame completion. Output 63 is inverted to develop a complementary output, designated Frame $\overline{\text{Complete}}$, which is utilized as a logic input for previously described logic gating circuits 54 which clock the third latch in each of frames 2–10.

Referring now to FIGS. 1 and 2, output bits $Q_2$ and $Q_4$ of adders 60 (sum of ball one and ball two scores) are shown applied to frame complete logic blocks 62. In each of frames 2–10, the frame complete output 64 is applied as an input to gating logic circuit 54 which clocks the third latch in the frame. The frame complete logic for frame 10 serves as a line complete signal as well as a frame 10 complete signal.

SCORE TOTALING

The arithmetic unit as herein described, collates successive ball scores (pin scores) into 30 latches such that frame score may be obtained by a simple summation of the scores stored in the three latches (representing the three possible score additions) for that frame. Th circuitry of FIGS. 1 and 2 provides latch outputs 30, 35, and 40 for frame 1 and latch outputs 47, 52 and 57 for each of frames 2 through 10.

FIG. 14 depicts a means for score totaling. Total score per frame is obtained by adding the output of the three latches in each frame. Then, starting at frame 1, the score of frame 1 is the sum of the three latch outputs in frame 1. The score of frame 2 is the score in frame 1 plus the sum of the three latch outputs in frame 2. The score of frame 3 is the score of frame 2 plus the sum of the three latch outputs in frame 3. This process, as depicted in FIG. 14, is continued through frame 10.

With reference to FIG. 14, adder 73 sums the frame 1 latch inputs to provide frame 1 score as adder output 74. Adder 75 provides a sum of frame 2 latches, while adder 77 adds frame 1 score to this summation to provide frame 2 total score at output 78. The sum 80 from adder 79 is added to frame 2 score 78 at 81 to produce frame 3 total score at output 82. The sum 84 from adder 83 is added to frame 3 score 82 at 85 to produce frame 4 total score at output 86. The sum 88 from adder 87 is added to frame 4 score 86 at 89 to produce frame 5 total score at output 90. The sum 92 from adder 91 is added to frame 5 score 90 at 93 to produce frame 6 total score at output 94. The sum 96 from adder 95 is added to frame 6 score 94 at 97 to produce frame 7 total score at output 98. The sum 100 from adder 99 is added to frame 7 score 98 at 101 to produce frame 8 total score at output 102. The sum 104 from adder 103 is added to frame 8 score 102 at 105 to produce frame 9 total score at output 106. The sum 108 from adder 107 is added to frame 9 score 106 at 109 to produce frame 10 total score (line total) at output 110.

Total score at any time in a line is the score of the last complete frame plus any score in the unfinished frame or frames. However, for display purposes, only the score of the last complete frame would be used. Frame completion signals, as herein discussed, are available to effect a display of the score of the last complete frame on a frame by frame basis as frames are completed.

Whereas this invention is herein illustrated and described with respect to a particular embodiment hereof, it should be realized that various changes may be made without departing from essential contributions to the art made by the teachings hereof.

I claim:

1. The method of automatically scoring in the game of bowling comprising the steps of:

developing in periodic time sequence on a common line, signals representing pin scores of balls successively rolled by a selected player;

applying said common line as input to each of 30 scratch memories arranged in 10 successive groups of three with each group representing a successive one of 10 scoring frames and each memory in a group of three each representing one of three possible scoring additions in that frame;

logically determining from the number of balls rolled, as determined from the number of successive pin scores on said common line, and the values of successive ones thereof, into which of said 30 scratch memories successive ones of said pin scores should be entered to represent a score addition;

gating, in time synchronism with the periodic appearance of each successive ball pin score on said common line, the value of that ball pin score into from one to three of said scratch memories as defined in the above step;

making a continuous summation of the ball pin scores in each successive group of three scratch memories with the total of the sums of all preceding groups of three scratch memories to obtain the existing bowling score, frame by frame; and resetting each of said 30 scratch memory means to zero subsequent to that period of time defined by 21 possible pin scores having been time sequenced on said common line.

2. In an automatic scoring apparatus for the game of bowling, means for collating successive ball pin scores on balls successively rolled by a bowler into ones of a plurality of thirty scratch memory means each corresponding to a possible score addition, with successive groups of three of said scratch memory means corresponding to possible score additions for respective ones of ten consecutive bowling frames, comprising:

means for circulating said successive ball pin scores on a common input line to each of said 30 memory means;

means for generating and applying a repeated timing waveform comprised of 21 consecutive pulses followed by a 22 reset timing pulse, and each in time correspondence with the presence of a successive one of said ball pin scores on said common input line, to a plurality of logic gating means associated individually with ones of said plurality of scratch memory means;

first, second and third logic means associated with each of said groups groups of three scratch memory means for logically determining from said ball pin scores the existence of a strike, spare and second ball being rolled condition, in an associated one of said ten frames;

means for applying respective logic output signals definitive of a strike, spare, and second ball having been rolled, as determined for a given frame, to predetermined ones of those of said logic gating means associated with a next successive frame;

means for generating in each said logic gating means a clock output signal therefrom when a logically determined score addition exists at that time and in that place;

means for applying each said clock output signal to the clock input of an associated one of said scratch memories to enter the then-existing one of said ball pin scores on said common input line into that scratch memory means; and means for resetting, at the time of said reset timing pulse, each of said logic gating means to ready same for a next subsequent logically conditioned clock pulse output signal generation while resetting the pin score numbers in said plurality of scratch memory means to zero.

3. The apparatus of claim 2, further comprising:

means for continuously adding the ball pin scores stored in said successive groups of three scratch memory means to obtain a score addition contributed by that frame; and further means for continuously adding each of the summations above with the sum of all preceding ones of said summations to obtain successive frame total score.

4. The apparatus of claim 2, wherein said first logic means for logically determining the existence of a strike condition comprises means responsive to the ball pin score stored in the first scratch memory means of each successive group of three memory means being equal to 10 to generate a strike condition definitive logic level output, and those of said logic gating means associated with the third scratch memory means of said first group of three scratch memory means, and to the first ones of each successive group of three scratch memory means, being responsive in part to said strike definitive logic level to generate a clock output pulse to associated ones of said scratch memory means.

5. The apparatus of claim 4, wherein said second logic means for logically determining the existence of a spare condition comprises means responsive to the sum of the ball scores clocked into the first and second scratch memory means of each successive group of three scratch memory means being less than ten, and further responsive to a logic level output from said third logic means definitive of the second ball in that frame having been rolled, to generate a spare definitive logic level output, and those of said logic gating means associated with the third one of said first group of three scratch memory means, and with the first one of each successive group of three memory means, being responsive in part to said spare definitive logic level to generate a clock output pulse to associated ones of said scratch memory means.

6. The apparatus of claim 5, further including frame completion determination logic means for each of said 10 frames, each said frame completion determination logic means comprises means receiving the sum of the ball pin scores clocked into the first and second scratch memory means of each successive group of three scratch memory means, and in response to the sum thereof being less than 10 together with a logical determination of the second ball in that frame having been rolled, generating a frame complete definitive logic level output, said frame completion determination logic means further receiving a logic input level in response to three balls having been rolled in that frame to generate said frame completion definitive logic level output, and those of said logic gating means associated with the third scratch memory means of each of said successive groups of three scratch memory means exclusive of the first group thereof, being additionally responsive to the complement of said frame completion definitive logic level output to generate a clock output pulse to the associated one of said scratch memory means.

7. The apparatus of claim 6, wherein the logical determination of two balls having been rolled in a frame is made by that one of the logic gating means associated with the second scratch memory means of each of said successive groups of three scratch memory means and comprises a further input to the logic gating means associated with the first scratch memory means of a next succeeding group of three scratch memory means.

8. The apparatus of claim 7, wherein said circulating sequential input ball pin scores comprise four-bit binary coded decimal equivalents of the number of pins knocked down by successively rolled balls, and each of said scratch memory means comprises a four-bit scratch memory into which said input ball pin scores are conditionally entered when present on said input line in time coincidence with the time occurrence of a clock input pulse to that four-bit scratch memory.

9. The apparatus of claim 8, wherein said first logic means for logically determining a strike condition comprises a first AND gate receiving the $Q_2$ and $Q_4$ bit outputs of an associated one of said four-bit scratch memory and providing said srike definitive output logic level when the binary number stored in that four-bit scratch memory is representative of the decimal number 10.

10. The apparatus of claim 9, wherein said second logic means for logically determining a spare condition comprises a second AND gate receiving the $Q_2$ and $Q_4$ bit outputs of a binary adder circuit which receives as inputs the respective outputs from first and second ones of the four-bit scratch in each of said successive groups of three scratch memories, said second AND gate further receiving such logic input definitive of the second ball in that frame having been rolled and providing said spare definitive output logic level when the binary number stored in that adder circuit is representative of the decimal number 10 and the second ball in that frame has been rolled.

11. The apparatus of claim 10, with a first one of said logic gating means associated with the first scratch memory of the first said group of three scratch memories and comprising a first J–K flip-flip, the J and clock inputs of said first flip-flop receiving the first one of said timing pulses as input thereto, a third AND gate receiving said first timing pulse and the Q output of said flip-flop as respective inputs, an OR gate receiving the output of said third AND gate and said reset timing pulse as respective inputs thereto, said rest timing pulse additionally being applied to the reset input of said first flip-flop, and the output of said OR gate comprising said clock input to said first scratch memory of said first group of three said scratch memories; the logic gating means associated with the second scratch memory of the first group of three scratch memories being like that of the logic gating means associated with the first scratch memory of said first group of three, with the AND gate thereof receiving a third input comprising the Q output of said first J–K flip-flop, and the timing pulse input thereto comprising the second one of said timing pulses; the logic gating means associated with the third scratch memory of said first group of three scratch memories comprising a third J–K flip-flop, an OR gate having first and second inputs respectively comprising the outputs of those of said first and second logic means respectively indicative of strike and spare conditions in said frame, the J input of said third flip-flop and a forth AND gate receiving the output of said OR gate as respective inputs thereto, said fourth AND gate receiving the Q output of said third flip-flop and the third one of said timing pulses as respective further inputs thereto, a further OR gate receiving the output of said fouth AND gate and said reset timing pulse as respective inpus thereto, said reset timing pulse being additionally applied to the reset input of said third flip-flop, and the output of said further OR gate comprising said clock Input to said third scratch memory of said first group of of three scratch memories.

12. The apparatus of claim 11, wherein each of those logic gating means associated with the first scratch memory of the second through tenth groups of three scratch memories comprises a fourth J–K flip-flop, OR gating means receiving outputs from those of said first, second and third logic means associated with a next preceding one of said frames, and responsive to strike and spare indicative logic output levels from such first and second logic means, or a second ball rolled definitive logic level from said third logic means, to provide a predetermined logic level input to the J input of said fourth flip-flop, a fifth AND gate receiving the Q output of said fourth flip-flop and the output of said OR gating means as respective first and second inputs thereto, a sixth AND gate receiving said successive timing pulses one through twenty-one as a third input thereto, an output OR gate gate receiving the output of said sixth AND gate and said reset timing pulse as respective inputs thereto, said reset timing pulse being additionally applied to the reset input of said fourth flip-flop, and the output of said output OR gate comprising said clock input to said first scratch memory of the associated one of said groups of three scratch memories; each of those of said logic gating means associated with the second scratch memory of the second through tenth groups of three scratch memories being like that of the first logic gating means associated with that frame, with the J input to the associated one of said flip-flops comprising the Q output of the flip-flop associated with the first logic gating means of the frame; and each of the logic gating means associatd with the third memory of the second through tenth groups of three memories being like that of the first logic gating means of that frame with said J input to the associated one of said flip-flops comprising the output of a further AND gating means receiving the Q output of the flip-flop associated with the second logic gating means of that frame and a logic level input from the frame completion determination logic means of that frame as respective inputs thereto, and the output of said further AND gating means comprising said J input to the associated one of said flip-flops.

* * * * *